US005369258A

United States Patent [19]

Sansone et al.

[11] Patent Number: 5,369,258

[45] Date of Patent: Nov. 29, 1994

[54] POSTAGE APPLYING KIOSK

[75] Inventors: Ronald P. Sansone, Weston; Michael D. O'Hare, Fairfield, both of Conn.; Steven M. Kaye, Bronx, N.Y.; Scott Korowotny, Oxford, Conn.

[73] Assignee: Pitney Bowes Inc., Stamford, Conn.

[21] Appl. No.: 99,367

[22] Filed: Jul. 29, 1993

[51] Int. Cl.[5] ..... G06R 7/08

[52] U.S. Cl. ..... 235/381; 235/375

[58] Field of Search ..... 235/375, 381

[56] References Cited

U.S. PATENT DOCUMENTS 4,800,505 1/1989 Axelrod ..... 235/375

4,900,905 2/1990 Pusic .

*Primary Examiner*—Harold Pitts

*Attorney, Agent, or Firm*—Ronald Reichman; Peter Vrahotes; Melvin J. Scolnick

[57] ABSTRACT

A metering kiosk in which postage is applied to a finished mail piece such as a postcard which has been provided with bar codes to indicate paper orientation for receipt with the kiosk and indicate the destination of the postcard. The metering kiosk has a touch screen monitor for convenient communication between the user and the logic of the kiosk. Although the primary function of the kiosk is to apply postage to a finished mail piece, convenience and entertainment of the user is a consideration.

14 Claims, 5 Drawing Sheets

POSTAGE APPLYING KIOSK

BACKGROUND OF THE INVENTION

Postal kiosks are know devices whereby one is able to post mail in a convenient fashion. Such kiosks are designed to receive the mail, weigh the mail, inform the user as to the amount of postage due and dispense the mail upon the user providing correct payment. Most kiosks have convenience items such as currency and coin changers. Although kiosks have been known for a long time, they have not been used extensively. An example of such kiosks is the Mail-O-Mat Mailing Machine produced by Pitney Bowes Inc. as far back as the 40's. This kiosk is described in U.S. Pat. No. 2,290,920. Since that time, a number of kiosks have been introduced and proposed, but none has achieved wide spread commercial success. One of the difficulties of prior kiosks may be that they have been attempting to achieve too much. For mechanisms to receive mail pieces of various sizes, weights and thickness's and having the mechanism of the kiosk determine the postage is not a simple task. As a result of attempting to achieve these functions, the prior kiosks have proven to be rather expensive and required a relatively large amount of service.

There is a need for a kiosk that is not only relatively simple in construction, but also serves the function of providing a degree of interaction with the user of the kiosk to render the same more interesting to use. In particular, it would be desirable to have a kiosk in an area such as a tourist area wherein finished mail pieces, such as postcards, can be conveniently mailed therefrom. Such a kiosk should have a limited number of functions to avoid complexity- Another advantage would be to have a kiosk that applies postage in accordance with a bar code on the mail piece. A further advantage would be to have a kiosk specifically designed to receive finished mail pieces and have the ability to determine correct orientation of the finished mail piece.

SUMMARY OF THE INVENTION

A postage applying kiosk has been conceived wherein a finished mail piece, such as a postcard, can have postage applied thereto in a convenient and attractive manner. Although the kiosk of the instant invention has the capability of processing any postcard, it is primary designed to apply postage to postcards that have been finished by another device and return the post card to the user. Such a mail finishing device is shown and described in concurrently filed patent application entitled "Postal Finishing Kiosk".

The kiosk of the instant invention is able to read bar codes on a mail piece for two different purposes. The first purpose of bar codes is to determine if the orientation of the postcard is correct and the second purpose of bar codes is to indicate the destination of the mail piece in terms of the country of destination. Because the kiosk is configured to accept only one type of mail piece, the postage will be dependent upon the destination of that mail piece that is indicated by one of the bar codes. Upon the destination being determined of the reading of this of bar code, a determination is made if the postage meter of the kiosk is set for the correct amount and, if not, it will be set accordingly. If the mail piece is not a finished mail piece and does not have the appropriate codes, a higher amount of postage is applied.

As the mail piece is transported through the kiosk to have the postage applied and returned, a display is provided whereby the location to which the mail is to be sent is shown and the route that the mail piece would take to arrive at its destination will be dynamically shown on a map imaged on the display in a manner for the benefit of creating interest in the user. After the postage has been applied to the mail piece, it is returned to the user.

DETAILED DESCRIPTION OF THE PREFERRED EMBODIMENTS

The instant invention is directed to a kiosk for applying postage on a mail piece such as a postcard with which the invention will be described. The user of the kiosk is not only informed as to the amount of postage required to post the postcard, but also is given visual images for the purpose of rendering the activity more attractive. The kiosk of the instant invention is fashioned to receive a finished mail piece, such as a finished postcard, and apply correct postage to the same. A finished postcard will be produced by a device such as a kiosk described in concurrently filed U.S. patent application entitled Postal Finishing Kiosk. It is assumed that a postal finishing kiosk of that type will print the appropriate bar codes, as will be described hereinafter, and print the name and address of the recipient in alphanumeric form.

Figure 1:
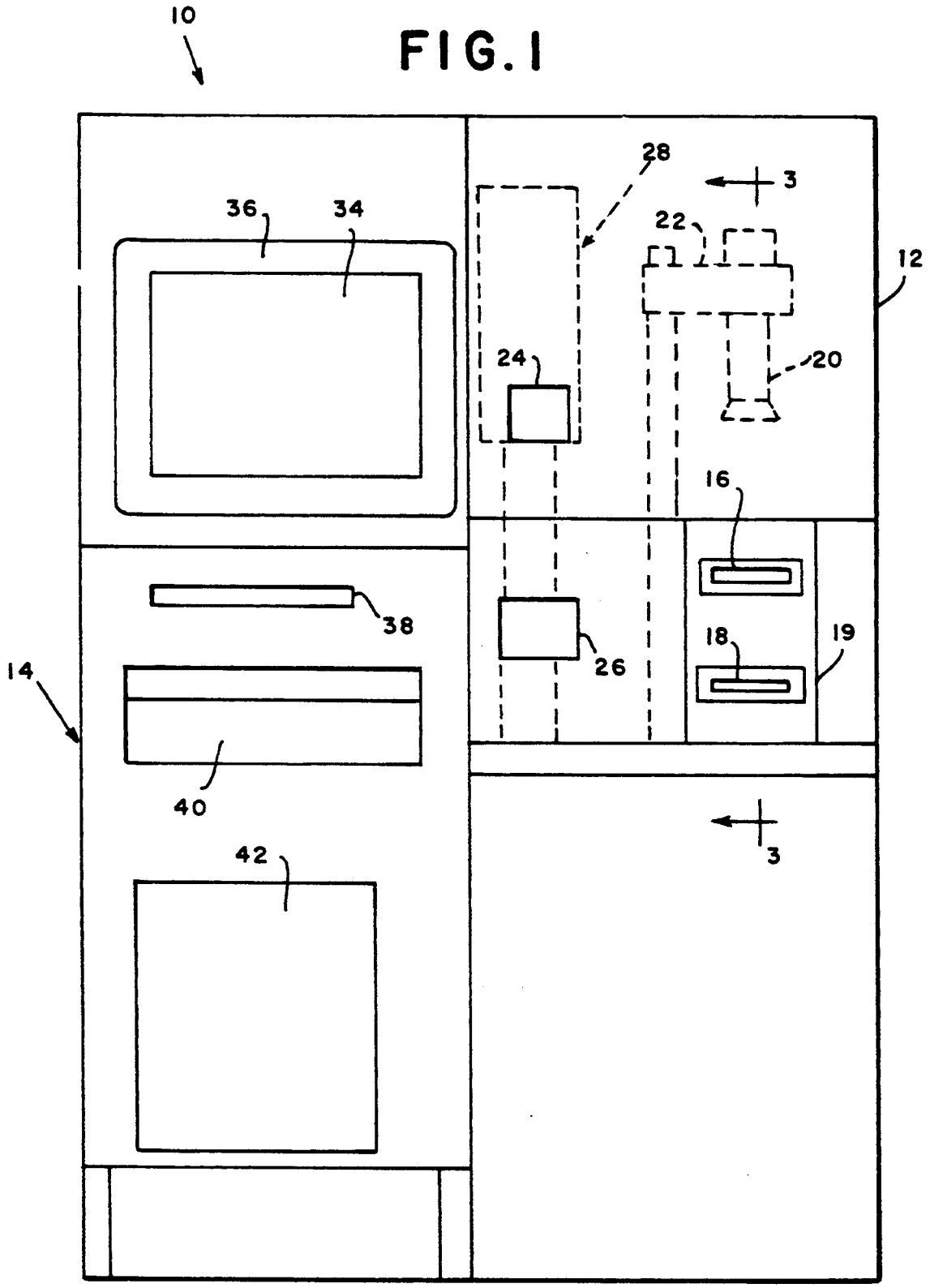
FIG. 1 is a front, plan view of a postage applying kiosk that practices the instant invention with interior portions shown in phantom.

Referring now to FIG. 1, a front view of a postage applying kiosk that practices the instant invention is shown generally at 10. The postal kiosk 10 has a housing 12 that includes a mail box portion 14. A slot 16 is provided for the receipt of a postcard, with the slot being part of a post card transport mechanism 19 whereby the postcard is conveyed through the kiosk 10 as will be described thereafter. Below the entry slot 16 is an exit slot 18, whereby the postcard is returned to the user after postage has been applied to the postcard as will be described. A camera 20 is supported within the housing 12 by a stand 22. The camera 20 is provided for the purpose of photographing the postcard after it enters through the entry slot 16.

A currency receiving slot 24 is provided for receiving coins and bills and a currency return slot 26 is located therebelow. The coin receiver slot 24 and coin return slot 26 are part of a currency handler 28. Currency handlers are well known devices receive payment and dispence change and will not be described in detail as the same does for part of the invention except to the extent of being a part thereof.

A screen 34, which can be the monitor of a computer, is supported by the housing 12. Preferably, the screen 34 is a touch screen, so as to provide convenient interaction between the user and the kiosk 10. The housing 12 has speaker openings 38 for speakers that will communicate prompts to the user. Below the speaker openings 38 is the mail slot 40 of the mail box 14 and a door 42 is provided for the purpose of allowing the postman to remove mail from the mailbox.

Figure 2:
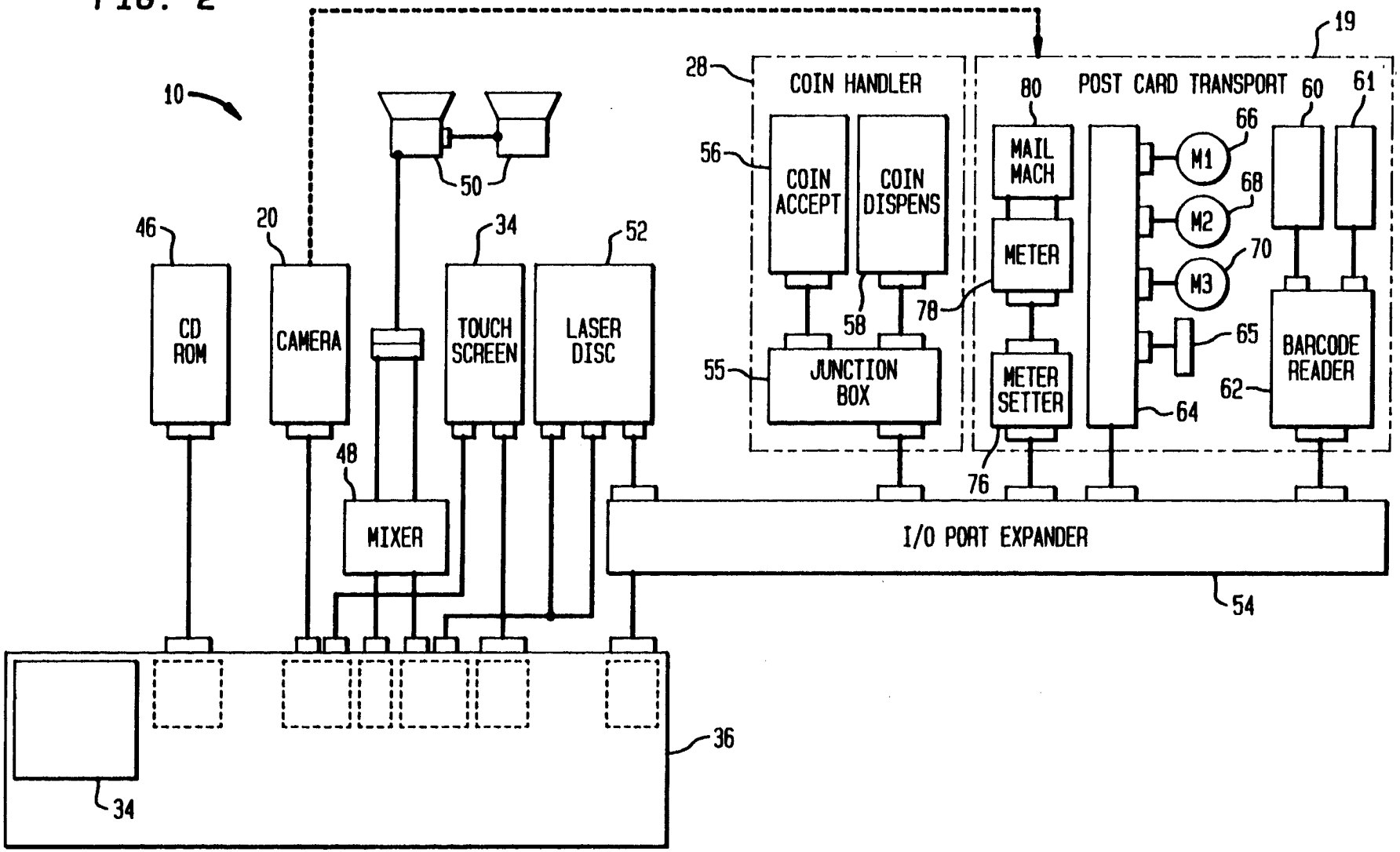
FIG. 2 is a block diagram of the circuitry of the postage applying kiosk shown in FIG. 1.

Referring now to FIG. 2, the circuitry of the kiosk 10 is shown in block diagram form. The circuitry includes a computer 36 that houses the screen 34, which can be a touch screen for purposes of providing input to the computer, or a keyboard can be provided for the same purpose as an option. The computer 36 can be any of a number of commercially available personal computers, but in the reduction to practice the invention, a Hewlett Packard Vectra 486/66ST was used with a Mitsubishi Model HC 3925A touch screen. The computer 36 is in communication with a CD ROM 46 that stores the program for the audio prompts, and a mixer 48 that communicates with a pair of speakers 50, the speakers being located at the opening 38 of the housing 12. The mixer coordinates activities among the touch screen 34, CD ROM 46, a laser disk 52 and the camera 20. The laser disk 52 stores audio and is connected to the computer 36 for the purpose of sending messages over the speakers 50 to give instructions to the users under control of the computer and CD ROM 46. An I/O port expander 54 is connected to both the computer 36 and laser disk 52 and is also connected to the coin handler 28 and the postcard transport mechanism 19. Within the coin handler 28 is a junction box 55 that communicates with the I/O port expanding and with a coin accepter 56 and a coin dispenser 58 that are connected to the receiving slot 24 and dispensing slot 26 of the housing 12, respectively.

The postcard transport mechanism system 19 will be described in greater detail with reference to FIG. 3, but is shown diagrammatically in FIG. 2, and includes a pair of sensor 61, 60 connected to a bar code reader 62 and a card conveyor 64. The card conveyor 64 has a solonoid 65 and motors 66, 68 and 70 whose functions will be described hereinafter. Also included in the postcard transport mechanism 19 is a meter setting device 76 that is connected to the I/O port expander and to a postage meter 78 to control the setting thereof. A mailing machine 80 is connected to the postage meter 78 to provide drive thereto. Meter setting devices 76, postage meters 78 and mailing machines 80, as well as the combination thereof, are well known and will not be described any further except with regard to their functioning within the housing 12.

Figure 3:
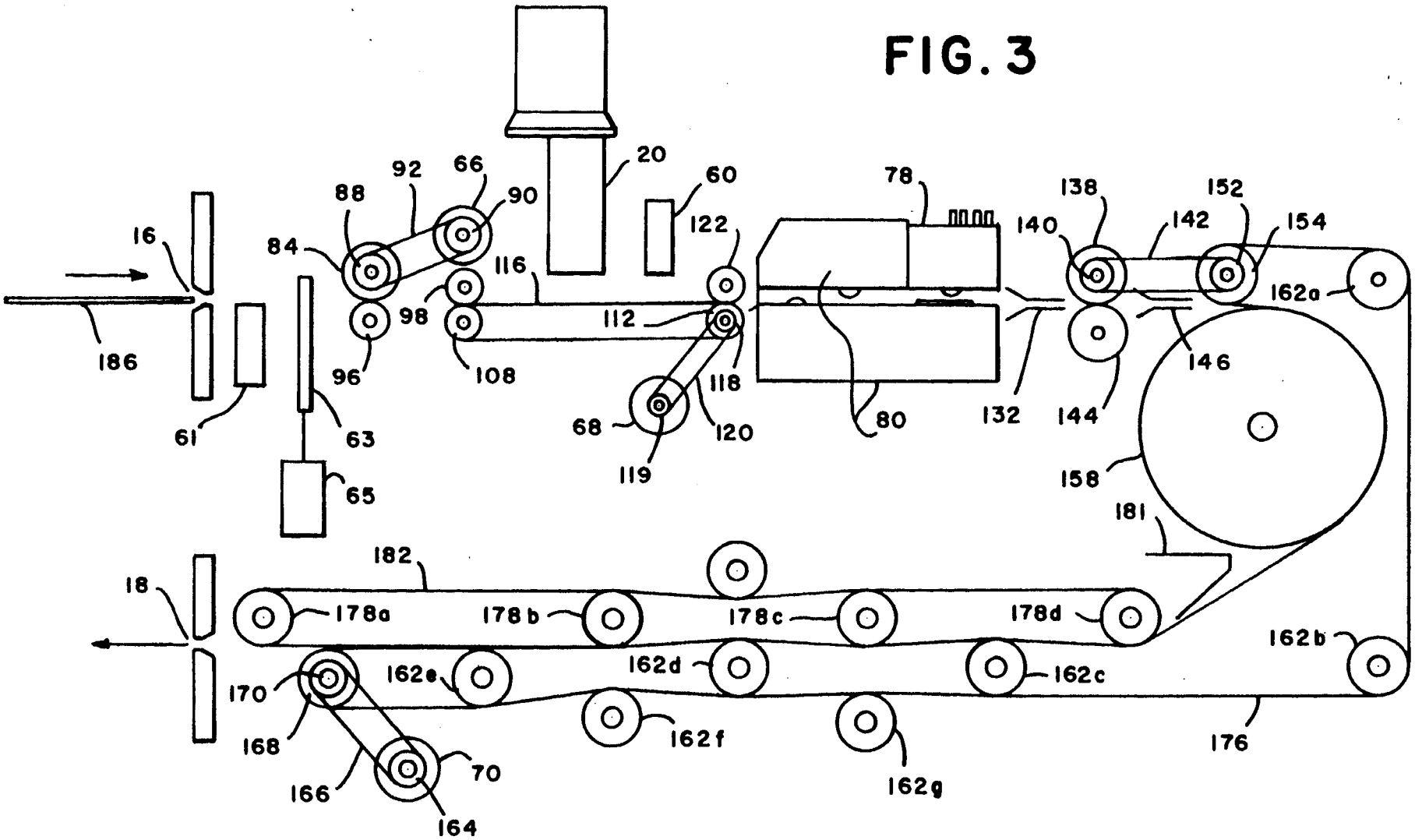
FIG. 3 is a cross-sectional view of the postal kiosks shown in FIG. 1 taken along the lines 3—3.

With reference to FIG. 3, the post card transportation mechanism will be described in greater detail. Immediately adjacent to the post card input slot 16 is a sensor 61 which is connected to the bar code reader which, in turn, is connected to the computer 36. A control gate 63 is connected to the solenoid 65 to be raised and lowered into and out of the path taken by a post card 186. This sensor 61 detects the presence of codes on post cards 186 to determine if they are oriented properly or whether the post cards are of the finished type. Upon sensing proper orientation of a postcard 186, the sensor 61 will enables the solenoid 65 to remove the gate 63 from the path of the post card. If no bar code is sensed by the sensor 61, the gate will open, but the computer will be aware that an unfinished post card has been received. Downstream from the gate 63 is a roller 84 that is rotatably supported within the housing and has a pulley 88 thereon. Another pulley 90 is secured to the output shaft of one of the motors 66. A belt 92 is trained about the pulleys 88, 90 for the purpose of providing drive to the roller 84. Immediately below and in contact with the roller 84 is an idler roller 96. Another idler roller 98 is rotatably supported by and located below the motor 66. A pair of rollers 108, 112 are rotatably supported by the housing 12 and have a belt 116 trained thereabout. A pulley 118 is coaxial with and connected to the roller 112. The second drive motor 68 has a pulley 119 on the output shaft thereof and a drive belt 120 is trained about the pulleys 118, 119 for the purpose of providing drive to the roller 112 and in turn to the belt 116. The idler roller 98 and another idler roller 122 are rotatably supported by the housing and in engagement with the belt 116. Located above the belt 116 is the camera 20 which can be a RGB Color Video Camera Model No. TK1070U with a zoom lens. Also located above the belt 116 is one of the sensors 60 which is connected to the bar code reader 62 and located between the rollers 98, 122. The bar code reader 62 is in communication with and actuates the screen 34 through the computer 36 so as to indicate to the user on the screen the amount of payment required in response to the sensor sensing the appropriate bar code as will be described hereinafter. Downstream from the rollers 112, 122 are the postage meter 78 and mail machine 80 that serve the function of conveying the postcard along its path and applying postage once a sufficient amount of currency has been supplied to the coin handler 28. It will be appreciated that the motor 68 can be a stepper motor that is idled following scanning by the sensor 60 until sufficient postage has been payed.

Downstream from the postage meter 78 is a chute 132 for guiding the postcard away from the postage meter 78 and downstream from the chute is a pair of contacting rollers 138, 144 for the purpose of continuing to transport the postcard. Downstream from the rollers 138, 144 is another chute 146. The roller 138 has a pulley 140 connected thereto and another pulley 152 is attached to a roller 154, there being a belt 142 trained about the pulleys 140, 152 for the purpose of imparting drive the roller 138. A plurality of rollers **162*a*–*g* support a belt 176 in conjunction with the roller 154 and a drum 158 that is rotatably supported by the housing, and another roller 168 which is coaxially connected to a pulley 170. The motor 70 has a pulley 164 attached to its output shaft and a belt 166 is trained about the pulleys 164, 170 for the purpose of driving the roller 168 thereby providing drive to the belt 176. Such drive to the belt imparts drive to the roller 154 which in turn imparts drive to the belt 142 and rollers 138, 144. Another plurality of rollers 178*a*–178*d* have an idler belt 182 trained thereabout and a guide plate 181 is located adjacent the drive belt 176 at the junction where it meets the idler belt 182. In this manner, a postcard 176 can be conveyed by the rollers 84, 96 onto the belt 116 where the belt in combination with the rollers 98, 122 will convey the postcard past the camera 20 and sensor 60 into the mail machine 80 after appropriate postage has been paid. Thereafter, the postage meter 78 will feed the postcard to the nip of the rollers 138, 144 towards the chute 146 to be fed between the belt 176 and the drum 158. The postcard will be rotated about the drum 158 and held by the belt 176 until it is guided by the guide plate 181 to the nip of the belts 176, 182 to be driven therebetween out the outlet slot 18**.

Figure 4A:
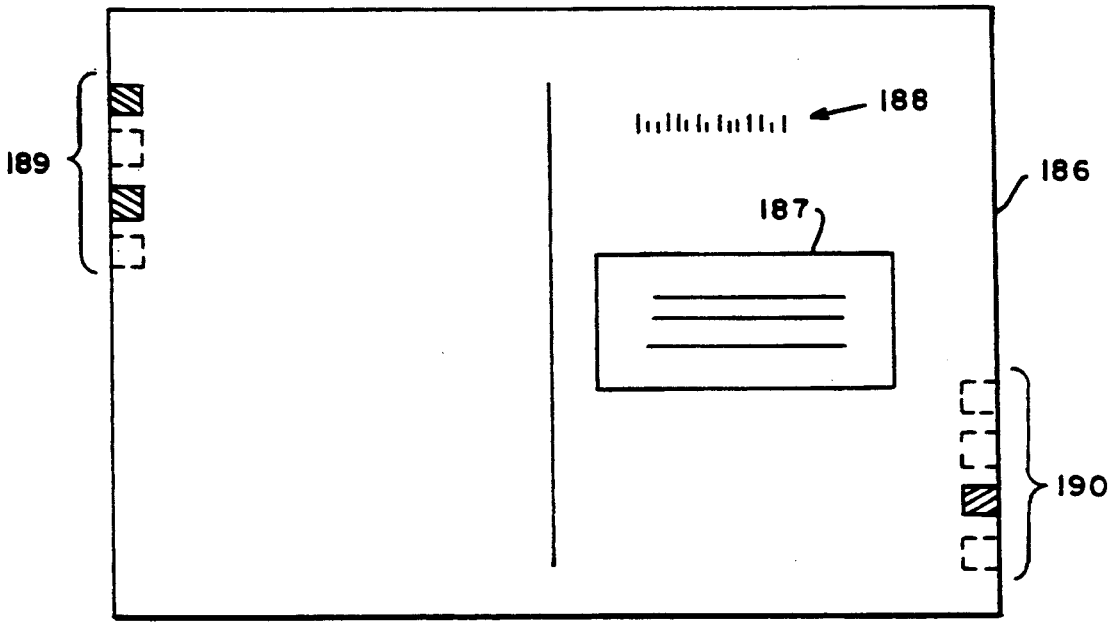
FIG. 4A is a plan view of the front of a finished postcard.
Figure 4B:
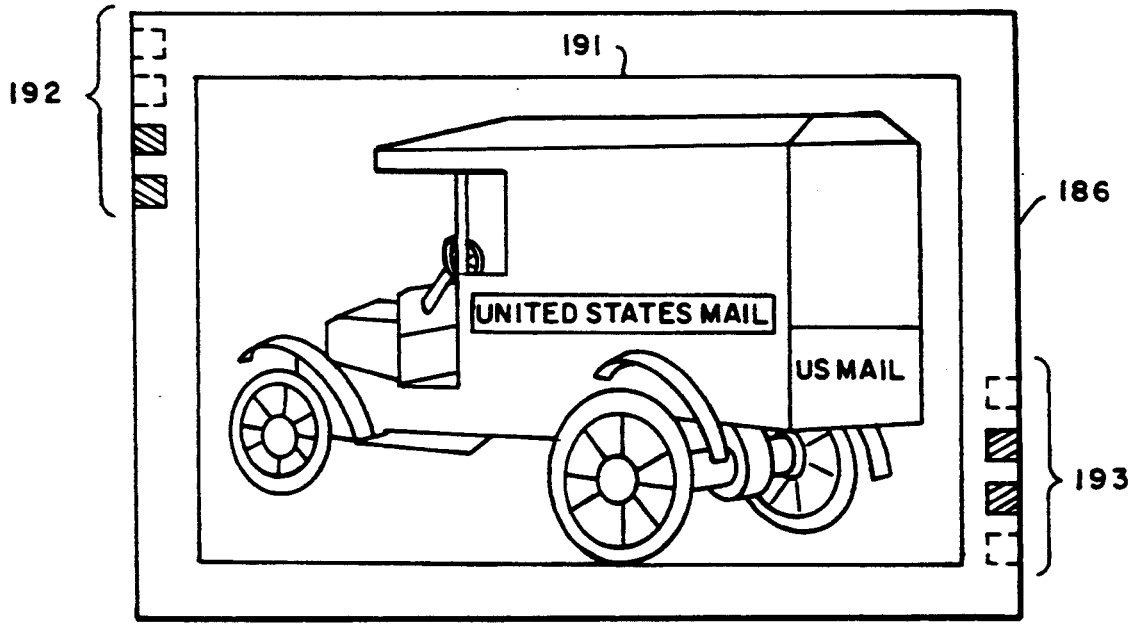
FIG. 4B is a plan view of the back of a finished postcard.

With reference now to FIGS. 4A and 4B, the front of a finished postcard is shown in FIG. 4A and the back of a postcard 186 is shown in FIG. 4B. It will be appreciated that the postcard 186 has been finished by another device such as that shown and described in concurrently filed patent application entitled "Postal Finishing Kiosk". The Postal Finishing Kiosk performs the task of finishing the postcard. By finishing is meant placing a correctly printed address block 187 having the name, street address, city, state and country of the recipient, a postnet bar code 188 for the benefit of assisting the post office in delivering the post card 186 and a first bar code 189 on one edge thereof, and another bar 190 at the other edge thereof. The codes 189, 190 use use a four bit code symbol, one of the codes 189 indicating the country category to which the postcard is to be sent. The other bar code 190 is for the purpose of notifying the computer 36 upon sensing by the sensor 61 that the postcard has not been inserted properly into the kiosk, but that the postcard is a valid one. On the backside of the postcard 186, FIG. 4B is a pictorial display 191, along with two other bar codes 192, 193 that use the same bar code symbol as on the front side. The first bar code 192 is the valid code that will indicate that the postcard 186 has been inserted in the slot 16 properly, while the second bar code 193 indicates that the card has not been inserted properly but is a valid card. By valid card is meant a card that has been finished by a finishing kiosk that has been discussed previously. Of course, the differences between the bar codes 189, 190, 192 and 193 is the combination of bars and spaces and locations thereof.

Figure 5:
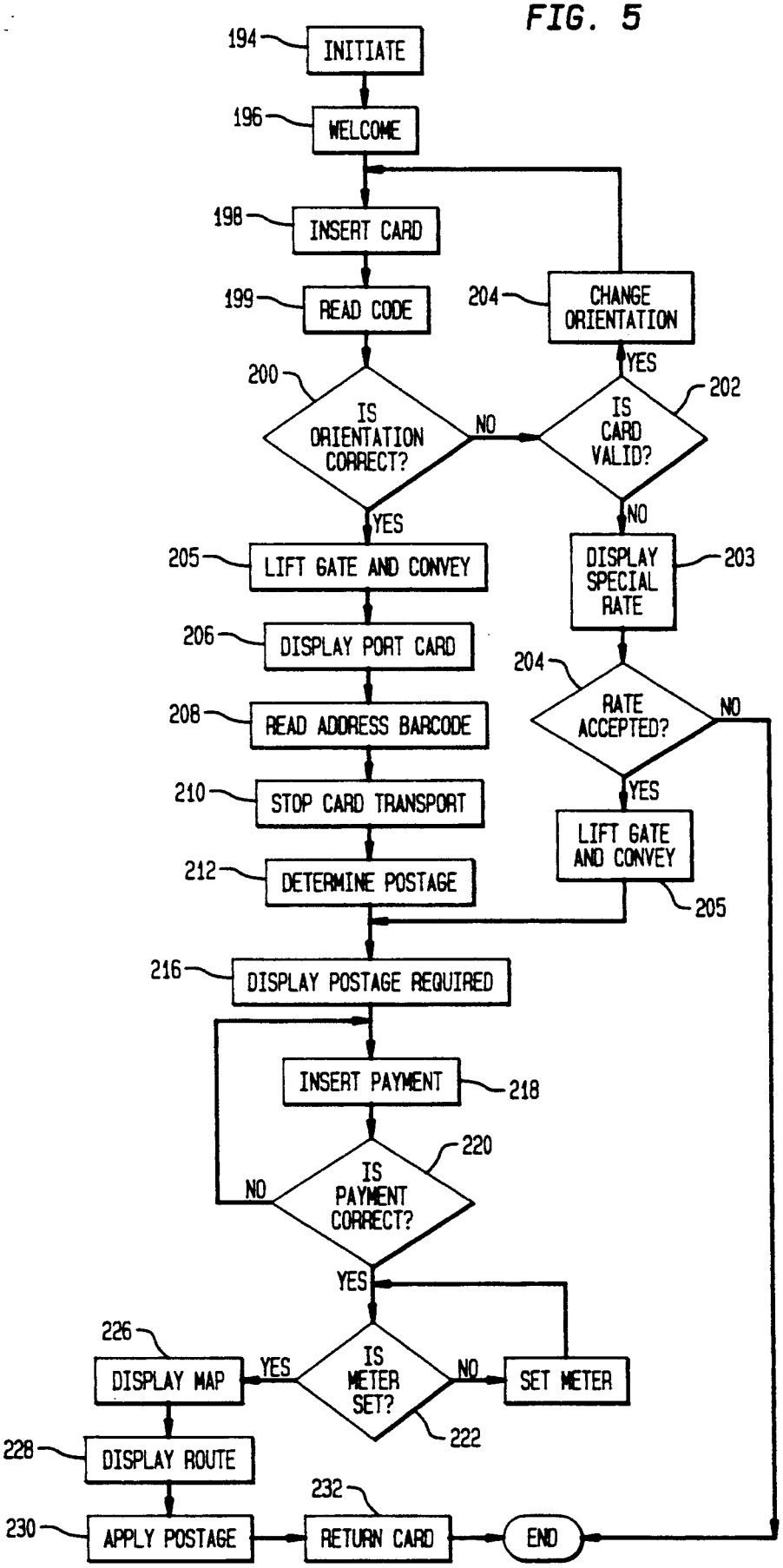
FIG. 5 is a flow chart representing a program for the kiosk shown in FIG. 1.

The operation of the kiosk will be described in conjunction with a flow chart shown in FIG. 5. The system is initiated 194 either by the postcard being inserted into the slot 16 and sensed or, preferably, by the user pressing a start location on the touch screen 34. Upon initialization, the screen 34 will display a welcome format 196 asking that the user insert the card 198 into the slot 16. As this is done, the code on the inserted portion of the card 186 is read 199 by the scanner 61 and a determination is made whether the card is properly oriented 200. This determination is premised upon the bar codes 192 on the picture 191 side being detected. If bar code 192 is read, then the orientation is correct, if not the question is asked whether the postcard is valid. If another bar code 189, 190 or 193 is read, then the orientation is improper and the user is given notice 204 as to how the card must be oriented for proper alignment. If no bar code is detected, then the system knows that it is not a valid postcard, but the non-valid post card will be accepted and a special rate will be displayed 203. The user will be asked if the special rate is accepted 204. If not the routine ends. Once a postcard has been inserted properly or a special charge is accepted, the gate 63 is removed from the entry slot 16 and the post card 186 is conveyed 205 into the kiosk 10. As the post card 186 is conveyed into the kiosk by the rollers 98, 122 and belt 116, an image of the address block is taken by the camera 20 and the image is displayed on the screen 34. The post card 186 will be conveyed past the sensor 60 and the bar code 189 will be read by the bar code reader 62 if the post card is valid. At this time, the stepper motor 68 will be disabled and the post card stopped 210 while the amount of postage is determined 212 for a valid card. There are four postage rates, postage for the mailing within the U.S., for mailing for either in Canada or Mexico, and a different postage for mailing in any other international location and the special rate. The first three are referred to as country categoriesi.e. the U.S. is one category, Canada and Mexico another, and all other countries a third category. The amount required to deliver the post card will be displayed 216 on the screen 34 and the user will insert the appropriate payment 218 through the slot 24. As described previously, change can be given with this type of device, but once the amount of postage is received, a determination is made if the amount is correct 220. If not, there is a return until either correct payment is received or the user cancels the proceedings by processing a cancel location on the screen 34 which is always displayed throughout the routine. Thereafter, an inquiry is made whether the postage meter is set correctly 222 and simultaneously with this, a map is displayed 226 and the route of the postcard will travel is displayed thereafter 229 in a dynamic manner. In the meantime, if the postage is not set correctly, the meter setting device 76 is actuated and the postage meter 78 is set 224 and there is a return. Upon the postage meter 78 being set at the proper amount, the postage is applied 230 and the post card 186 returned 232 to the sender. At this point, the routine ends. Thereafter, the sender can drop the postcard in the mail box 14.

Thus, what has been shown and described is a relatively simple postage applying kiosk capable of applying postage to finished postcards and which provides interaction between the user and kiosk so as to make use of the kiosk more attractive. The kiosk accepts the post card and applies postage in accordance with a bar code printed on the post card.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A kiosk for applying postage to a mail piece having a bar code thereon, comprising:

a) means for defining a path of travel for a mail piece, b) means for conveying a mail piece along said path, c) scanner means located on the path of travel, d) a bar code reader in communication with said scanner for reading the bar code on a mail piece being conveyed along said path, and e) postage applying means in communication with said bar code reader for applying postage to a mail piece in response to said bar code reader reading a bar code on a mail piece.

2. The kiosk of claim 1 further including a computer in communication with said sensor, said bar code reader and said postage applying means.

3. The kiosk of claim 2 further including a setting device in communication with said computer and said postage applying means for setting said postage applying means in response to said bar code reader.

4. The kiosk of claim 3 wherein said postage applying means is a postage meter.

5. The kiosk of claim 2 further including a movable blocking member located along said path of travel and a second scanner located at the upstream end of said path of travel in communication with said blocking member.

6. The kiosk of claim 2 further including a camera in communication with said computer and located along said path of travel.

7. The kiosk of claim 2 further including a touch screen in communication with said computer.

8. The kiosk of claim 2 further including means for inputting payment connected to said computer.

9. A method of applying postage to a finished mail piece having a bar code thereon, the steps comprising:

a) reading the bar code on the mail piece, b) setting a postage applying device in accordance with the reading of the bar code, and c) applying postage to the mail piece in accordance with the setting of the postage applying device.

10. A method of applying postage to a finished mail piece having orientation bar codes and a postage value bar code thereon, the steps comprising:

a) inserting a finished mail piece into a kiosk, b) reading one of the bar codes to determine if the finished mail piece has to be inserted into the kiosk properly, c) reading the postage value bar code, d) setting the value of a postage applying device in response to the reading of the postage value bar code, and e) applying postage to a mail piece with the set postage value device.

11. The method of claim 10 wherein the step of inserting a finished mail piece into a kiosk is the step of inserting a finished post card into the kiosk.

12. The method of claim 10 wherein the step of setting a postage applying device is the step of setting a postage meter.

13. The method of claim 10 further including the step of displaying a notice upon a determination that a mail piece has not been inserted properly and giving instructions as to how the post card should be oriented to be inserted properly into the kiosk.

14. The method of claim 10 wherein the step of reading the postage value bar code includes displaying the amount of postage required to post a mail piece and including the further step of supplying the determined amount of postage to the kiosk.

* * * * *